US006637338B2

(12) United States Patent
Veil

(10) Patent No.: US 6,637,338 B2
(45) **Date of Patent: *Oct. 28, 2003**

(54) METHOD FOR PREPARING VARYING DEGREES OF GLOSS ON PRINTED MATTER IN PRINTING MACHINES

(75) Inventor: Jürgen Veil, Dresden (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/054,291

(22) Filed: Nov. 13, 2001

(65) Prior Publication Data

US 2002/0175981 A1 Nov. 28, 2002

(30) Foreign Application Priority Data

Nov. 16, 2000 (DE) ..... 100 57 642

(51) Int. Cl.[7] ..... B41F 7/02; B05D 1/28

(52) U.S. Cl. ..... 101/491; 101/217; 101/424.1; 101/424.2; 118/46; 427/372.2

(58) Field of Search ..... 101/211, 277, 101/424.1, 424.2, 491, 487, 488; 118/46, 58, 262; 427/511, 372.2

(56) References Cited

U.S. PATENT DOCUMENTS 4,939,992 A * 7/1990 Bird ..... 101/183
5,651,316 A * 7/1997 DeMoore et al. ..... 101/450.1
6,299,685 B1 * 10/2001 Siler et al. ..... 118/58
6,443,058 B1 * 9/2002 Stadler et al. ..... 101/23

* cited by examiner

*Primary Examiner*—Leslie J. Evanisko
*Assistant Examiner*—Leo T. Hinze
(74) *Attorney, Agent, or Firm*—Goodwin Procter LLP

(57) ABSTRACT

The present invention relates to a method and apparatus for preparing varying degrees of gloss on printed matter in printing machines producing printed images on printed matter by application of an ink layer. An object of the present invention is to provide a method for producing varying degrees of gloss on printed matter with only one coating tower which comprises only one coating unit and no especially manufactured coating plate. The method according to the present invention comprises applying an ink layer from at least two ink systems on a substrate to be printed to produce a printed image. The printed image is subsequently coated with a coating, whereby each ink system changes degree of gloss in reaction with the coating layer.

13 Claims, 1 Drawing Sheet

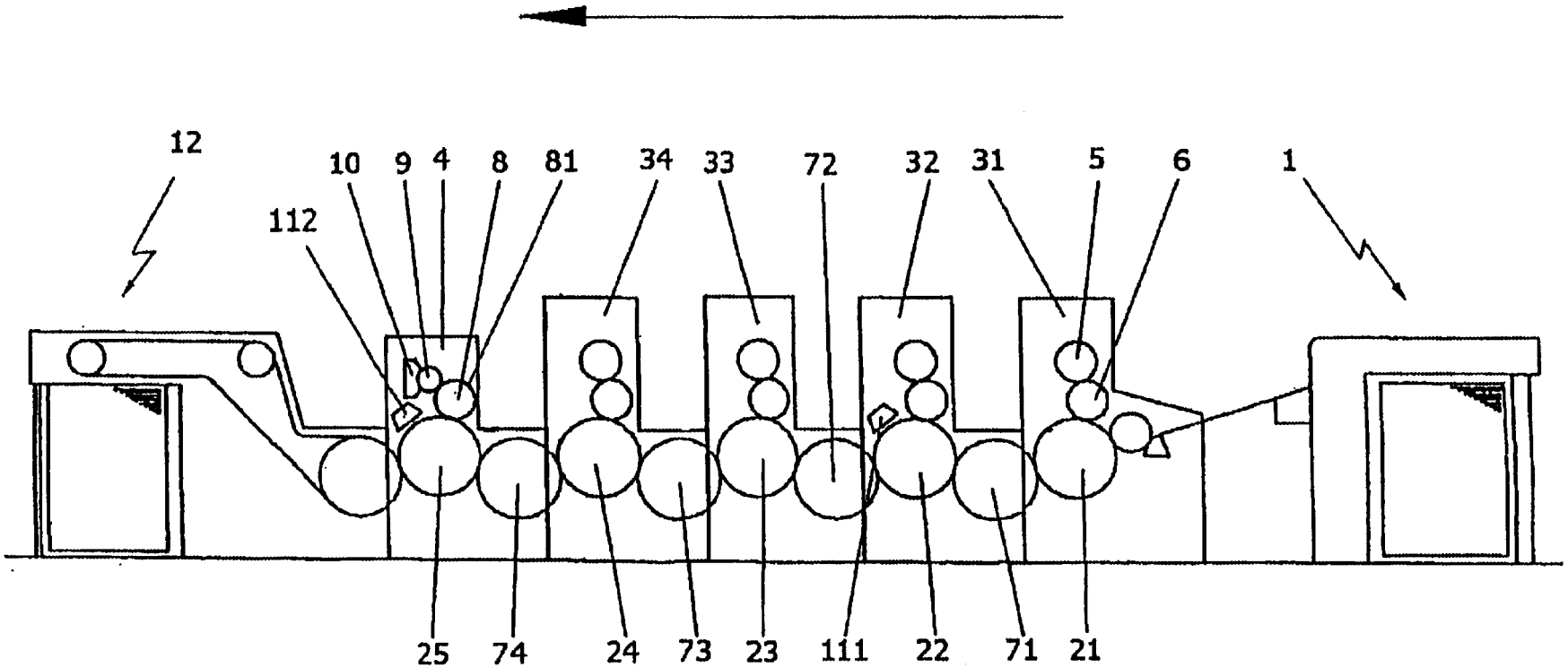
1
6
5
31
32
72
33
34
81
8
4
9
10
112
12
21
71
22
111
23
73
24
74
25

METHOD FOR PREPARING VARYING DEGREES OF GLOSS ON PRINTED MATTER IN PRINTING MACHINES

FIELD OF THE INVENTION

The present invention relates to a method and apparatus for preparing varying degrees of gloss on printed matter in printing machines, which produces printed images on printed matter by application of an ink layer.

BACKGROUND OF THE INVENTION

Varying degrees of gloss on a surface of printed matter is usually produced by printing plates used as coating plates, which are especially made for this purpose. These printing plates have partial recesses. The process is described in the $9^{th}$ edition of the book "Offsetdrucktechnik" (Offset printing) by Helmut Teschner on pages 11 to 43. The book also describes the limitation of this technique that fractional heavy overprinting is required for particular protruding gloss effects.

The costly manufacturing of the coating plates is also disadvantageous. Multi-stepped gloss effects on a printed image require a lot of efforts by using multiple coating plates in multiple coating units.

SUMMARY OF THE INVENTION

An object of the present invention is to establish a method for producing varying degrees of gloss on printed matter with only one coating tower comprising only one coating unit and no especially manufactured coating plate.

The present invention accomplishes this by producing a method comprising applying an ink layer from at least two different ink systems on a substrate to be printed to produce a printing image. The printed image is subsequently coated with a coating, whereby each ink system changes degree of gloss in reaction with the coating layer.

The present invention has an advantage that varying degrees of gloss can be produced with only one coating plate without partial recesses. The manufacturing costs for the coating plate is decreased. The coating plate can be used for several printing jobs so that the make ready time is reduced. Furthermore, only one coating unit or coating tower is required.

BRIEF DESCRIPTION OF THE DRAWING

The present invention is described below in greater detail by an exemplary embodiment of the present invention and by reference to the following drawing:

The FIGURE is a schematic drawing of a sheet fed offset press in unitized design.

DETAILED DESCRIPTION OF THE INVENTION

The sheet fed offset press in the FIGURE has multiple printing units 31 to 34 arranged in unitized design. The embodiment shows four printing units 31 to 34 as an example. At least two printing units are required for the method according to the present invention.

A feeder 1 precedes the printing units 31 to 34. Structure and function of the feeder 1 are known and will not be described herein. Each of the printing units 31 to 34 has an impression cylinder 21 to 24, a plate cylinder 5 and a blanket cylinder 6. The plate cylinder 5 and the blanket cylinder 6 are only denoted in the printing unit 31. The sheet travel direction is marked with an arrow. The FIGURE also shows the transfer drums 71 to 74 located between two of the impression cylinders 21 to 25. The transfer drums 71 to 74 can also be embodied as perfecting drums in perfecting presses. The impression cylinders 21 to 24 and the transfer drums 71 to 74 are sheet guiding cylinders of a double diameter. Inking and dampening units allocated to each printing unit 31 to 34 are not shown in the FIGURE.

The shown printing units 31 and 32 print with an ink system containing ink constituents which dry under radiation, normally ultraviolet radiation. The printing units 33 and 34 print with a typical offset ink.

In the embodiment, a dryer 111 is allocated to the printing unit 32. The dryer 111 must be selected for drying the ink system used, which is in this case an ultraviolet (UV) dryer.

A coating tower 4 follows the printing units 31 to 34 in the direction of the sheet travel. It has a coating form cylinder 8 allocated to the impression cylinder 25. The coating form cylinder 8 carries a coating plate 81. The coating tower 8 coats the printed image with a coating layer, which also dries under radiation.

A screened roller 9 is allocated to the coating form cylinder 8 with respect to the coating plate 81. The screened roller 9 is equipped with a chamber doctor blade 10 for coating supply. A dryer 112 is allocated to the coating tower 4.

The coating tower 4 is followed by a delivery unit 12. Structure and function of the delivery unit 12 are known and will not be described herein.

This apparatus can realize the following method according to the present invention:

A sheet to be printed is supplied by the feeder 1 and forwarded by unshown means in the sheet travel direction. The ink of an ink system is applied in the printing units 31 to 32 through the blanket cylinder 6. The ink system contains proportional ink hardening under radiation, in the exemplary embodiment, under ultraviolet radiation. These inks are denoted as hybrid inks.

Inks with substantially the same processing characteristics are referred to herein as ink systems.

Optionally, after printing, the printed sheet can be dried with the dryer 111 before the sheet is transferred to the next printing units 33 and 34. The printed sheet is then printed with an ink system comprising other inks, for instance, inks typically used for offset printing.

It is also possible that the ink system uses a typical printing ink vehicle, for instance, a varnish.

A coating is applied next over the printed sheet by the coating plate 81 in the coating tower 4. The coating has the characteristics to react differently with the ink systems physically and/or chemically and thus, to create varying degrees of gloss in the ink layer. A colorless coating hardening like a hybrid ink under ultraviolet light is used in the exemplary embodiment. The coating layer is then dried in the dryer 112.

An additional feature for the above-mentioned effect is that the ink systems may differ from each other in their capacity of coating absorption. The degree of gloss is reciprocally proportional to the capacity of the ink system for absorbing the coating, whereby for ink layers of ink systems with lower capacity for coating absorption, more coating retains at their surfaces; for ink layers of ink systems with higher capacity for coating absorption, less coating retains at their surfaces. The gloss-determining constituents of the coating may be picked up by the ink layers.

The coating is almost totally absorbed by the ink layer if an ink system vehicle is applied as coating on the surface. This is necessary, for example, during printing of pasted seams of packaging material, which has to be free of coating for subsequent application of an adhesive.

The present invention is not limited to the above mentioned differences in capacity for coating absorption. Rather, it includes all ink systems changing degrees of gloss or gloss effects through any interaction with the coating layer. Nevertheless, drying and/or hardening of the printed sheet or the printed matter after printing with additional energy may not always be necessary. Other process treatments of the ink layers and/or coating layers are possible in order to obtain varying degrees of gloss on the final coating layer by physical and/or chemical reactions.

In another exemplary embodiment of the present invention, the process treatment can be eliminated totally or partially. The above mentioned effects are obtained by selection of suitable ink systems and a corresponding coating.

LIST OF REFERENCE NUMERALS

| | |
|---|---|
| 1 | Feeder |
| 21, 22, 23, 24, 25 | Impression Cylinder |
| 31, 32, 33, 34 | Printing Unit |
| 4 | Coating Tower |
| 5 | Plate Cylinder |
| 6 | Blanket Cylinder |
| 71, 72, 73, 74 | Transfer Drum |
| 8 | Coating Form Cylinder |
| 81 | Coating Plate |
| 9 | Screened Roller |
| 10 | Chamber Doctor Blade |
| 111, 112 | Dryer |
| 12 | Delivery |

I claim:

1. A method for producing varying degrees of gloss on printed matter, comprising the steps of:

applying an ink layer from at least two ink systems to produce a printed image on said printed matter;

coating said printed image with a coating to form a coating layer; and altering degrees of gloss on said printed image through reaction of said at least two ink systems with said coating layer.

2. The method according to claim 1, wherein said at least two ink systems react physically and/or chemically with said coating layer.

3. The method according to claim 1, wherein said at least two ink systems differ in capacity for absorption of said coating.

4. The method according to claim 1, wherein said degrees of gloss are reciprocally proportional to a capacity for absorption of said coating for said at least two ink systems, whereby for an ink layer of an ink system with lower capacity for absorption more coating retains at a surface of said ink layer, and for an ink layer of an ink system with higher capacity for absorption less coating retains at a surface of said ink layer.

5. The method according to claim 1, wherein gloss determining constituents of said coating can be absorbed by said ink layer.

6. The method according to claim 1, wherein said coating is colorless.

7. The method according to claim 1, wherein one of said at least two ink systems comprises an hybrid ink comprising proportional ink hardening under radiation and another of said at least two ink systems comprises a typical offset ink.

8. The method according to claim 1, wherein one of said at least two ink systems comprises a typical vehicle for printing inks.

9. The method according to claim 8, wherein said typical vehicle for printing inks is a varnish.

10. The method according to claim 1, further comprising hardening said coating by radiation.

11. The method according to claim 1, wherein one of said at least two ink systems comprises an hybrid ink; said hybrid ink and said coating are hardened by ultraviolet light.

12. A method for producing varying degrees of gloss on printed matter, comprising the steps of:

applying an ink layer from at least two ink systems to produce a printed image on said printed matter;

treating said at least two ink systems after application in a process;

coating said printed image with a coating to form a coating layer; and altering degrees of gloss on said printed image through reaction of each of said at least two ink systems with said coating layer.

13. The method according to claim 12, wherein said at least two ink systems are treated in said process by hardening and/or drying after application.

* * * * *